United States Patent [19]

Cardellini

[11] 4,441,834

[45] Apr. 10, 1984

[54] LOOSE LEAF BINDER

[76] Inventor: Claudio B. Cardellini, Rua Manuel Maria Tourinho, 673, 01236 Sao Paulo SP, Brazil

[21] Appl. No.: 304,366

[22] Filed: Sep. 21, 1981

Related U.S. Application Data

[63] Continuation-in-part of Ser. No. 127,544, Mar. 6, 1980, abandoned.

[30] Foreign Application Priority Data

Mar. 13, 1979 [BR] Brazil ..... 7901568

[51] Int. Cl.[3] ..... B42F 13/22

[52] U.S. Cl. ..... 402/55; 402/41

[58] Field of Search ..... 402/30, 31, 26, 55, 402/41, 20, 27, 28, 29

[56] References Cited

U.S. PATENT DOCUMENTS

| | | | |
|---|---|---|---|
| 1,439,367 | 12/1922 | Krag | 402/41 |
| 2,548,618 | 4/1951 | Purvis | 402/55 |
| 2,598,044 | 5/1952 | Emmer | 402/55 |
| 3,162,198 | 12/1964 | Dennis | 402/30 |
| 4,349,289 | 9/1982 | Cardellini | 402/30 |
| 4,349,290 | 9/1982 | Cardellini | 402/55 |
| 4,355,916 | 10/1982 | Cardellini | 402/31 X |

*Primary Examiner*—James M. Meister
*Assistant Examiner*—John S. Brown
*Attorney, Agent, or Firm*—Cushman, Darby & Cushman

[57] ABSTRACT

An arrangement is provided for retaining loose sheets of paper. A pair of sheet retaining components, each having a plurality of half loops, are hingedly held together by wire clips. An actuator is interposed between the sheet containing components. The actuator is provided with inclined slots which, when the actuator is displaced, engage and move the clips causing one sheet retaining component to move with respect to the other to unlock the engaged ends of the respective half loops. Once unlocked, the sheet retaining components can be hinged apart to permit removal and/or addition of loose leaf paper. Means are provided to retain the actuator in proper and secure operative position between the sheet retaining components.

6 Claims, 4 Drawing Figures

LOOSE LEAF BINDER

This application is a continuation-in-part of application Ser. No. 127,544, filed Mar. 6, 1980, now abandoned.

BACKGROUND OF THE INVENTION

Conventional loose leaf binders come in a variety of forms. Each suffers disadvantages from an economic and/or functional point of view. Attempts to produce inexpensive binders from materials which are not costly, e.g., plastics, typically have resulted in products which do not securely retain sheets of paper or which do not readily permit new sheets to be added to the retainer or removed therefrom.

The present invention relates to an improved loose leaf binder which is relatively inexpensive, provides secure retention of papers, and permits sheets of paper to be easily added to or withdrawn from the binder. More particularly, the invention constitutes an improvement over that disclosed in U.S. Pat. No. 4,349,289, dated Sept. 14, 1982, by providing a simplified arrangement for retaining the various portions of the invention in operative relationship with respect to one another.

SUMMARY OF THE INVENTION

The present invention includes a pair of sheet retaining components each comprising an elongated strip and a plurality of half loops secured thereto. The strips are hinged together by a first set of wire clips. An actuator is interposed between the strips and is secured in relatively slideable relationship with respect to the strips by a second set of wire clips. The actuator includes a plurality of inclined slots intermediate its edges and arranged such that when the actuator is moved relative to the strips, the first set of clips is received within respective slots. This results in one retaining component being displaced with respect to the other whereby interlocking or abutting ends of the half loops on the respective strips are separated allowing the strips to be parted.

DETAILED DESCRIPTION OF THE INVENTION

This invention will be described in greater detail with respect to the accompanying drawings illustrating the present invention, wherein:

FIG. 4 is an exploded perspective view of a variation of the embodiment of the invention illustrated in FIG. 1.

Figure 1:
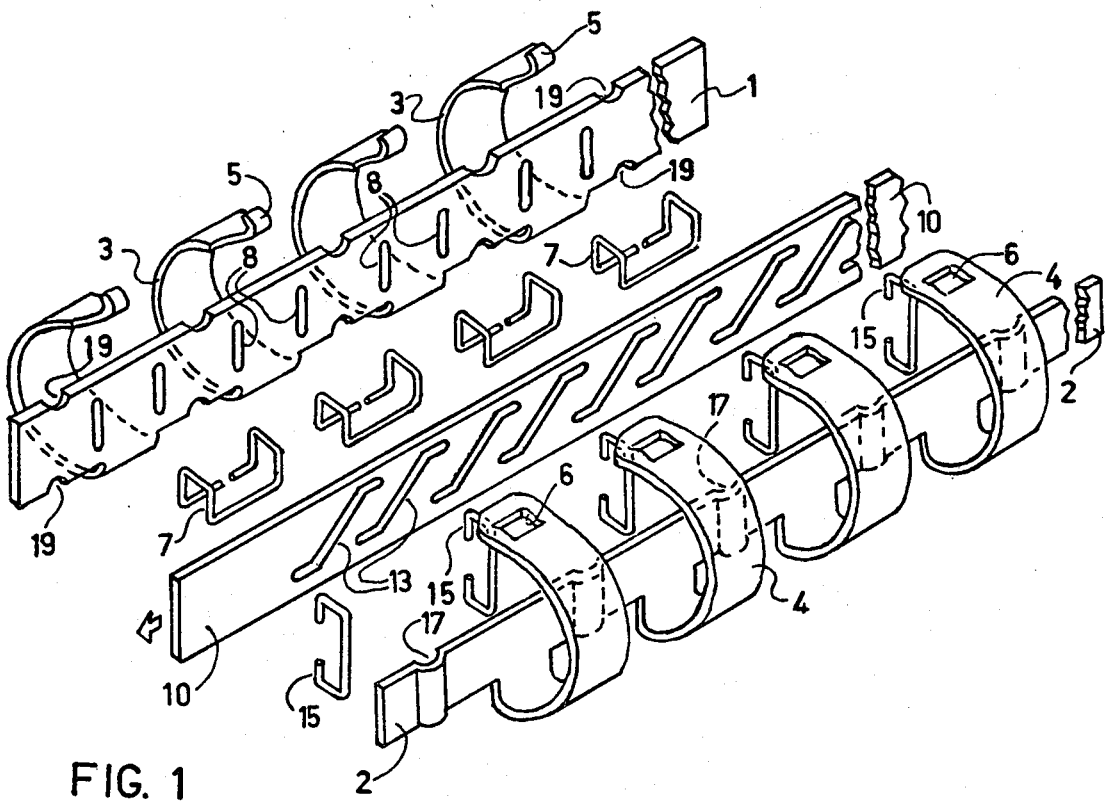
FIG. 1 is an exploded perspective view of a first embodiment of the invention.
Figure 2:
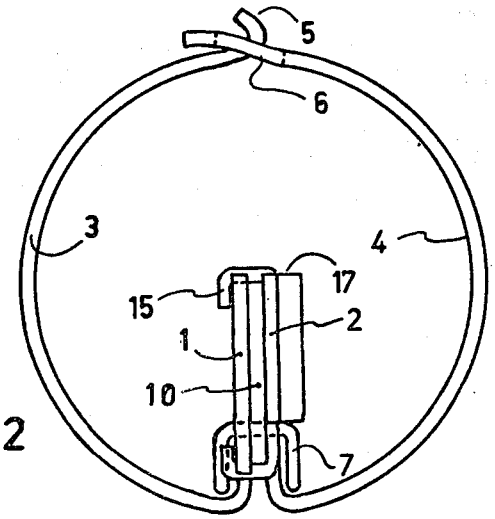
FIG. 2 is an end view of the embodiment shown in FIG. 1 illustrating the arrangement of the components thereof when the retainer is in a fully closed position.
Figure 3:
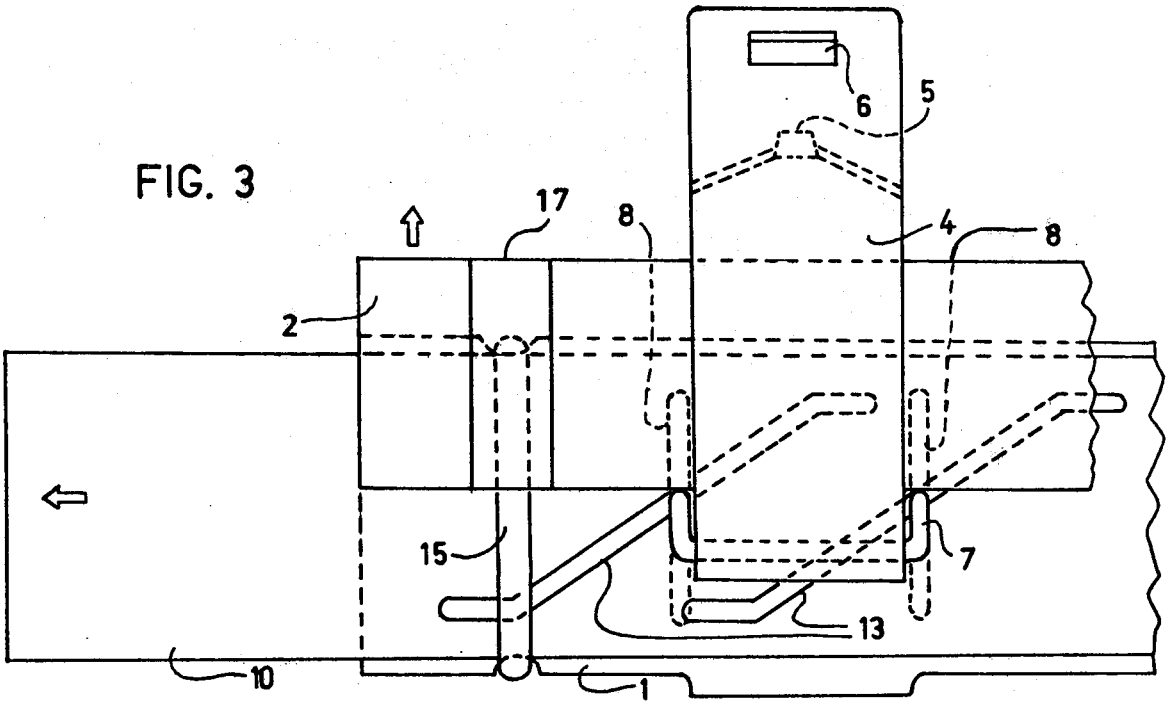
FIG. 3 is an elevational view of the embodiment shown in FIG. 1 illustrating the cooperation of the components thereof as the half loops are unsecured to permit the binder to be opened.

Referring now to the drawings, disclosed in FIGS. 1–3 are a pair of sheet retaining components, clips for interconnecting these components and an actuator component for selectively displacing the sheet retaining components from a locked mating relationship to an unlocked and separated one. More particularly, a first sheet retaining component comprises an elongated strip 1 having integrally associated therewith at spaced locations along one of its edges a plurality of half loops 3 terminating in partially turned back ends 5. A second sheet retaining component comprises an elongated strip 2 which also has associated therewith, at spaced locations corresponding to the spacings along strip 1, a plurality of half loops 4 having slots 6 adjacent their free ends. Slots 6 are dimensioned so as to be able to receive the ends 5 of loops 3.

Adjacent the intersection of the edges of the half loops 3 and strip 1, the strip is provided with parallel pairs of slots 8. These slots extend transversely of the length of strip 1 and terminate intermediate the edges of the strip. Each pair of slots receives the parallel arms of a wire clip 7. The parallel arms of the clip are joined by a U-shaped web, and the free ends of the arms are bent in L-shape extending towards one another. With the free ends of the clips 7 being positioned between half loops 3 and strip 1, and the webs of the clips passing beneath the lower edge of strip 2 and being located between half loops 4 and strip 2, the pair of sheet retaining components are held together in hinged relationship.

As is apparent from the drawings, the half loops 3 and 4 are arranged on their respective strips 1 and 2 such that when the strips are in abutting relationship, complete loops are formed for retaining sheets of paper. These loops are locked against inadvertent opening when the ends 5 of loops 3 are received within slots 6 of loops 4. However, when the loops are unlocked in a manner hereinafter to be described, the sheet retaining components may be displaced 180° from one another due to their hinged connection. The displacement is limited only by the engagement of the outside surfaces of the half loops 3 and 4.

The actuator component for unlocking and separating the sheet retaining components will be described with reference to FIGS. 1 and 3. The actuator component comprises an elongated strip 10 having a length slightly greater than that of strips 1 and 2. The strip 10 is provided with a plurality of pairs of inclined parallel slots 13. The slots of each pair are separated by a distance corresponding to the spacing between the spaced parallel arms of clip 7 and by the distance separating the slots of each pair 8 formed in strip 1. The ends of each inclined slot connect with slotted extensions which run parallel to the longitudinal edges of actuator 10.

As can be appreciated particularly from FIG. 1, the actuator 10 is sandwiched between strips 1 and 2, and means are provided to permit the actuator to slideably move relative to the strips. The latter function is achieved by providing a plurality of generally C-shaped wire clips 15 which are received within spaced indentations or grooves 17 formed in strip 2, the grooves being oriented transversely to the length of the strip. The free ends of clips 15 pass over the longitudinal edges of actuator 10 and are received in notches 19 provided in the longitudinal edges of strip 1. By this arrangement, strips 1 and 2 are retained in position relative to one another while the actuator is free to move in its longitudinal direction.

With the actuator 10 slideably joined to strips 1 and 2 as just described, and with strips 1 and 2 hinged together by clips 7, the parallel arms of each clip project through corresponding slots 13 in strip 10. Consequently, with the binder closed, as shown in FIG. 2, upon displacement of actuator 10 with respect to strips 1 and 2 in the direction shown by the arrowheads in FIGS. 1 and 3, the parallel arms of clips 7 move out of the longitudinally-running extensions of the actuator slots and into the inclined slots 13. Continued displacement of the actuator causes the parallel arms of clips 7 to rise along their associated slots 8 and 13 causing strip 2 to be elevated (as shown in FIG. 3), thereby disengaging the ends 5 of loops 3 from the slots 6 in loops 4. The transverse slots 8 in strip 1 prevent the interconnected strips 1 and 2 from being displaced in the direction of movement of the actuator 10. With the loop ends separated completely by the continued rise of clips 7 along slots 8 and 13 into the upper longitudinally oriented extensions of slots 13, the loops may be pivotally displaced with respect to one another due to the hinging action of clips 7 with respect to strips 1 and 2. This permits sheets to be removed from loops 3 and/or 4, or added thereto. To close the binder again, it is enough to return loops 3 and 4 to a position substantially as shown in FIG. 3 and then to displace the actuator 10 in the direction opposite to the arrowheads of FIGS. 1 and 3 so as to cause the ends 5 to again be received within slots 6 thereby locking the sheet retaining components against relative rotation with respect to one another.

Referring now to FIG. 4, a second embodiment of the invention will be illustrated. For convenience, elements generally corresponding to those included in the embodiment of FIGS. 1–3 are identified by like numbers in FIG. 4.

In the arrangement of FIG. 1, clips 15, and the cooperating grooves 17 and notches 19 in strips 2 and 1, respectively, are eliminated in favor of different structure for retaining the strips in position while the actuator 10 moves relative thereto. More particularly, parallel pairs of slots 8, and associated clips 7, are provided adjacent alternate ones of the half loops 3. Adjacent the remaining half loops, pairs of apertures 21 are formed in strip 1 to receive the arms of C-shaped clips 23 which also pass through respective elongated slots 25 extending longitudinally of actuator 10. The arms of clips 23 also are received within slots 27 provided in strip 2 adjacent the intersections of those alternate half loops 4 which cooperate with the half loops 3 adjacent apertures 21. In a fashion comparable to the way clips 7 interconnect strips 1 and 2, the clips 23 similarly retain the strips while allowing the actuator 10 to move longitudinally with respect to the strips. The slots 27 are oriented transversely to the length of strip 2.

The operation of the embodiment of FIG. 4 is identical to that described with respect to the first embodiment of the invention. Therefore, it is unnecessary to repeat the description except to note that the actuator 10 is permitted to move in the direction of the arrowhead by virtue of the elongated slots 25 accommodating the arms of clips 23.

With the arrangements just described, sheets of paper are securely retained until the actuator is displaced to unlock and open the half loops permitting sheets to be added or removed from the binder. When this occurs, the actuator can again be displaced in an opposite sense to permit relocking of the half loops.

The turned back ends 5 and respective apertures 6 are optional in the second embodiment of the invention. Therefore, in this embodiment, the free ends of the half loops 3 and 4 may simply be formed as shown in FIG. 4.

What is claimed is:

1. A loose leaf binder comprising:

a pair of elongated strips each having a plurality of half loops joined to an edge thereof at corresponding spaced locations along said edge, the ends of said half loops being arranged so as to form full loops when the strips are positioned in juxtaposition;

a plurality of clip means hingedly interconnecting said strips;

means provided on one of said strips for permitting movement of said clip means transversely of said strip;

an actuator interposed between said strips in movable relationship thereto, said actuator having a plurality of parallel inclined slots located intermediate its edges and adapted to receive said clip means whereby when said actuator is moved in a direction longitudinally of said elongated strips, movement of the clip means within said slots displaces the clip means transversely of said one strip and engages an edge of the other strip thereby moving said other strip to separate its half loops from the half loops of said one strip; and additional clip means operatively related to said strips and the actuator to prevent transverse movement of the actuator relative to one of said strips while permitting the actuator to move longitudinally relative to the strips.

2. A loose leaf binder as set forth in claim 1, further including:

means provided at the ends of said half loops to permit interlocking of the loops when the strips are positioned in juxtaposition, said interlocking means comprising an aperture in one half loop and a bent end portion of another half loop which is received within said aperture when said loops cooperate to form a full loop.

3. A loose leaf binder as set forth in claim 1, wherein:

said means for permitting movement of the clip means transversely of said one strip includes pairs of parallel slots in said strip extending transversely to the length of said one strip and located intermediate its longitudinal edges, each of said pair of slots receiving a clip means.

4. A loose leaf binder as set forth in claim 1, wherein said additional clip means comprises at least one C-shaped clip oriented transversely of said strips, said clip being received within a recess in one of said strips and within notches provided in the longitudinal edges of the other of the strips.

5. A loose leaf binder as set forth in claim 1, wherein said additional clip means comprises at least one C-shaped clip oriented longitudinally of said strips, said clips being received in apertures provided in one of the strips, passing through an elongated longitudinal slot in the actuator and being received within transversely extending slots in the other of said strips.

6. A loose leaf binder as set forth in claim 1, wherein said inclined slots are provided with extensions at opposite ends thereof extending longitudinally of the actuator.

* * * * *